US005657114A

United States Patent [19]

Kitajima et al.

[11] Patent Number: 5,657,114

[45] Date of Patent: Aug. 12, 1997

[54] IMAGE FORMING APPARATUS WITH CLEANING CAPACITY CHANGEABLE IN ACCORDANCE WITH IMAGE DENSITY

[75] Inventors: Tatsuya Kitajima, Tokyo; Natsuki Tachibana, Yokohama, both of Japan

[73] Assignee: Kabushiki Kaisha Toshiba, Kanagawa-ken, Japan

[21] Appl. No.: 527,027

[22] Filed: Sep. 12, 1995

[30] Foreign Application Priority Data

Nov. 18, 1994 [JP] Japan ..... 6-285274

[51] Int. Cl.[6] ..... G03G 21/10

[52] U.S. Cl. ..... 399/71; 355/297

[58] Field of Search ..... 355/208, 296, 355/297, 279

[56] References Cited

FOREIGN PATENT DOCUMENTS

| | | | |
|---|---|---|---|
| 56-60473 | 5/1981 | Japan | 355/208 |
| 57-62080 | 4/1982 | Japan | 355/296 |
| 62-254173 | 11/1987 | Japan . | |
| 1-68783 | 3/1989 | Japan | 355/296 |
| 2-244170 | 9/1990 | Japan . | |
| 5-2358 | 1/1993 | Japan | 355/208 |

*Primary Examiner*—Joan H. Pendegrass
*Attorney, Agent, or Firm*—Limbach & Limbach LLP

[57] ABSTRACT

A copying machine comprises a cleaning device for cleaning toner remaining on the surface of a photoconductive drum, and a sensor for detecting image density of an image to be formed on the drum. The cleaning device includes a cleaning blade arranged to contact with drum, and an auxiliary cleaning mechanism arranged upstream the cleaning blade with respect to the rotating direction of the drum. The auxiliary cleaning mechanism has variable cleaning capacity. The cleaning capacity of the auxiliary cleaning mechanism is varied by a control unit in accordance with the image density detected by the sensor.

13 Claims, 8 Drawing Sheets

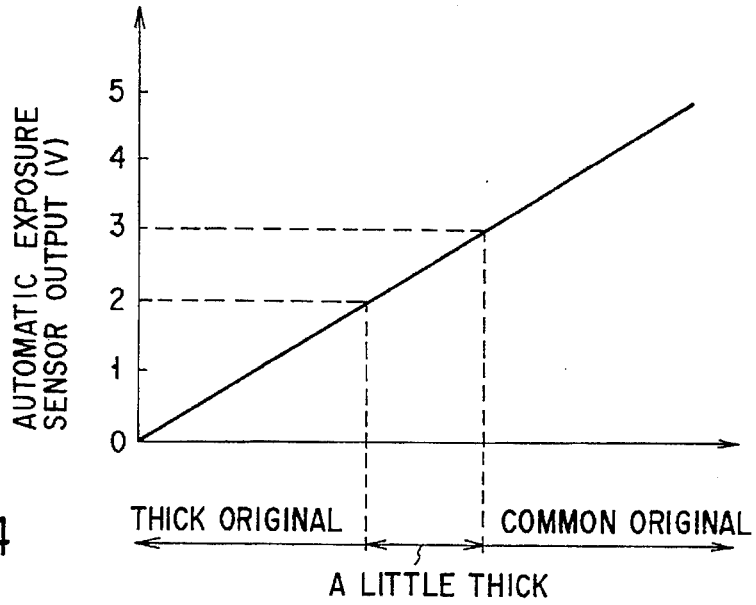
FIG. 4
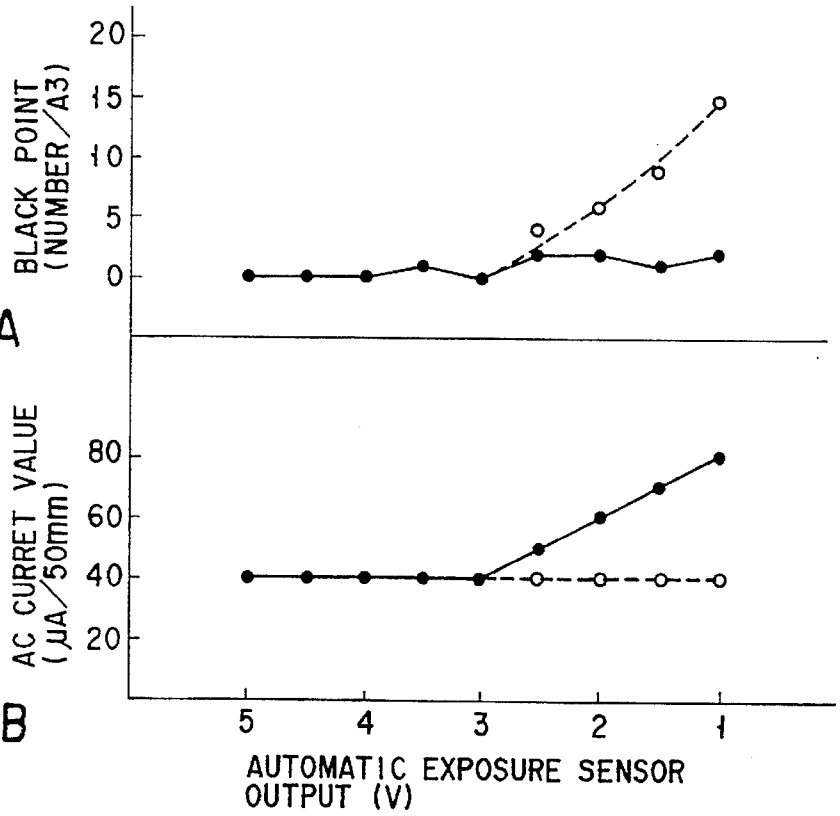
FIG. 5A
FIG. 5B

FIG. 6A
FIG. 6B
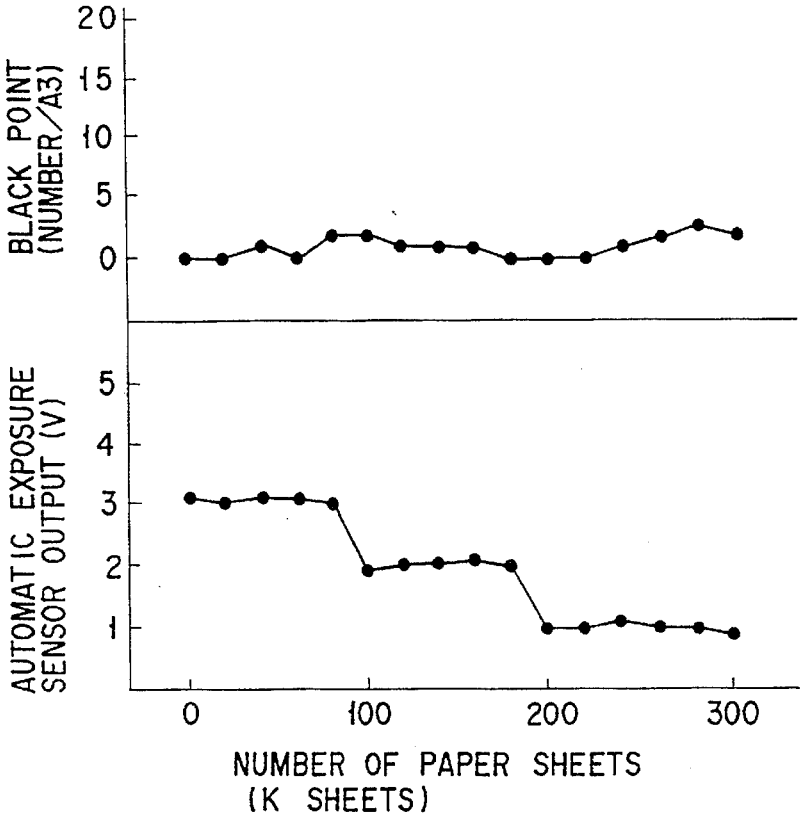
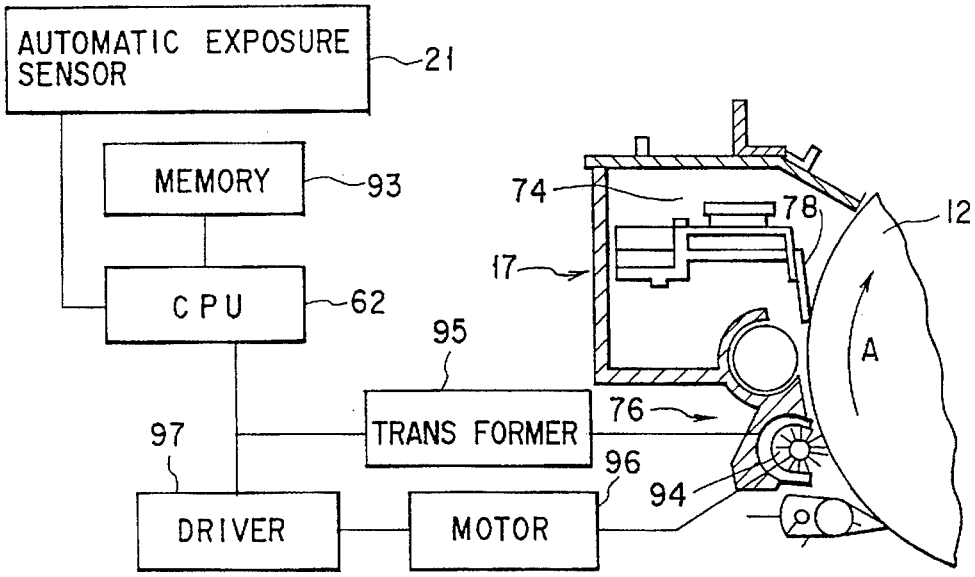
FIG. 7

FIG. 8A
FIG. 8B
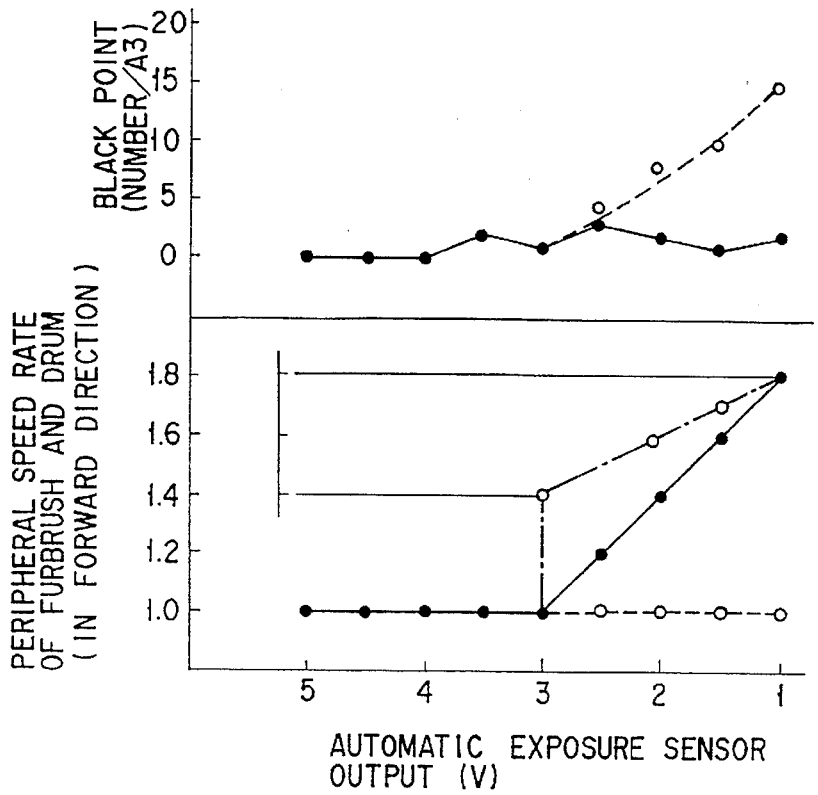
FIG. 9A
FIG. 9B
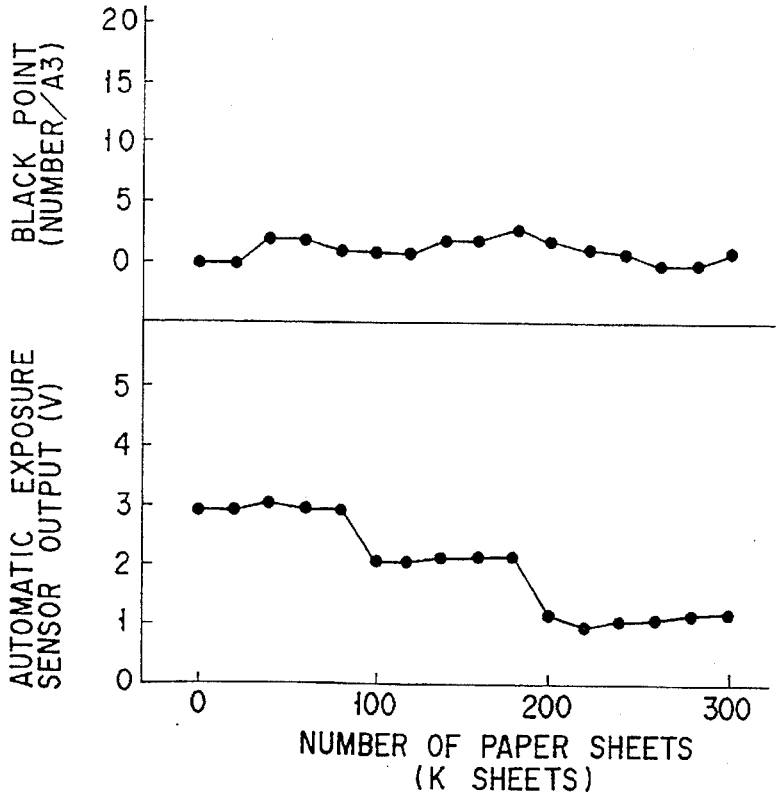

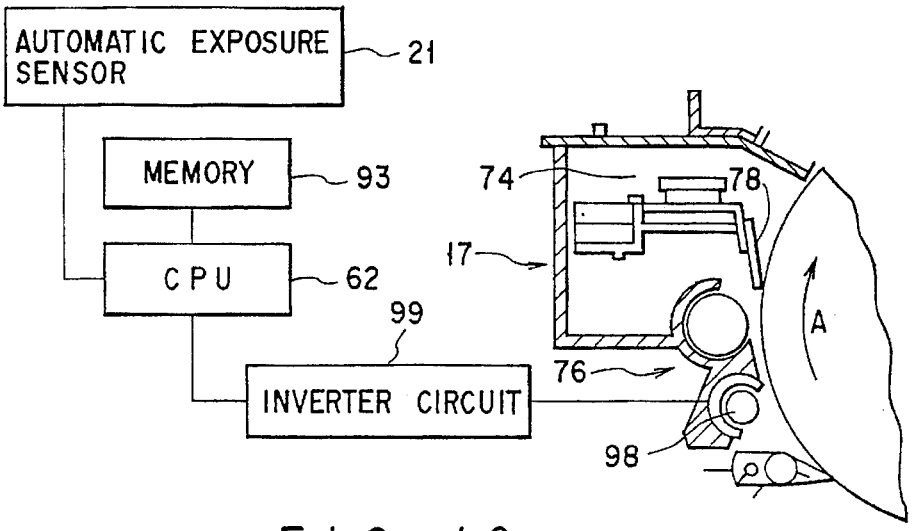
FIG. 10
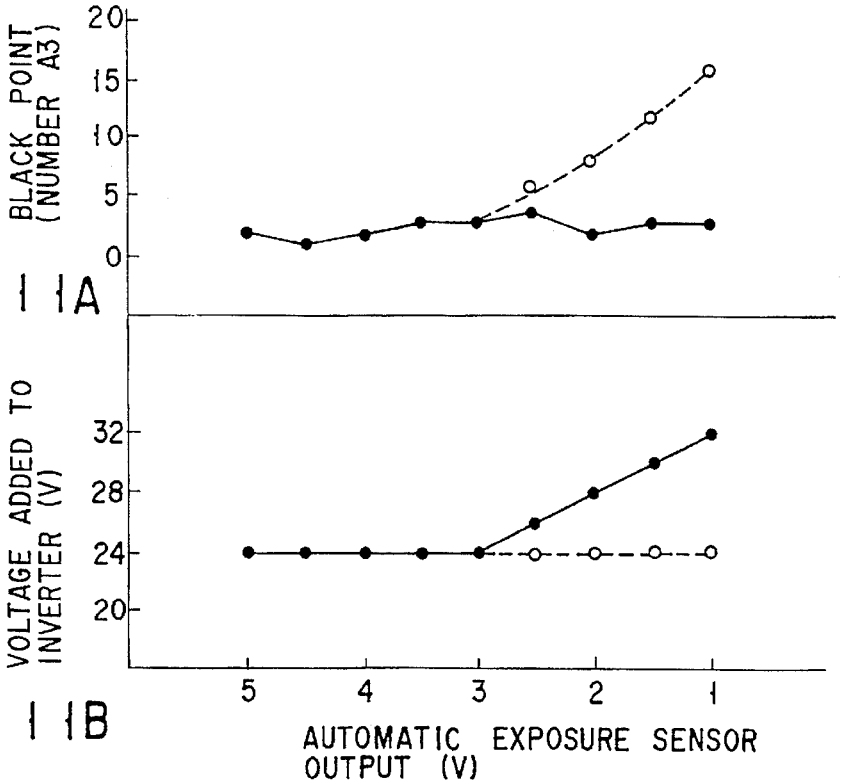
FIG. 11A
FIG. 11B

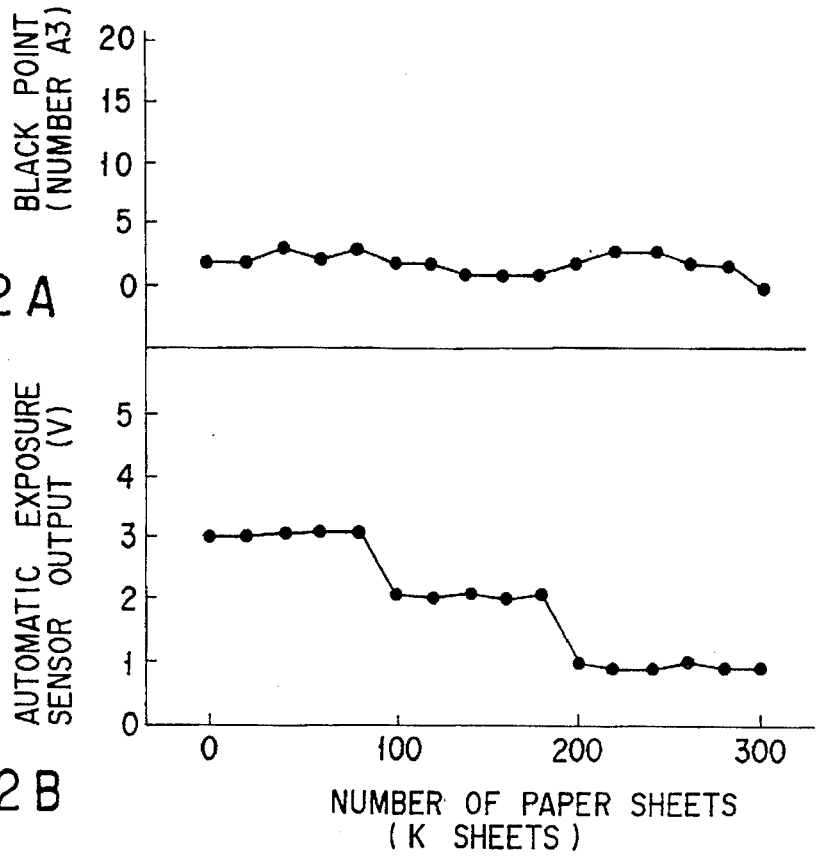
FIG. 12A
FIG. 12B
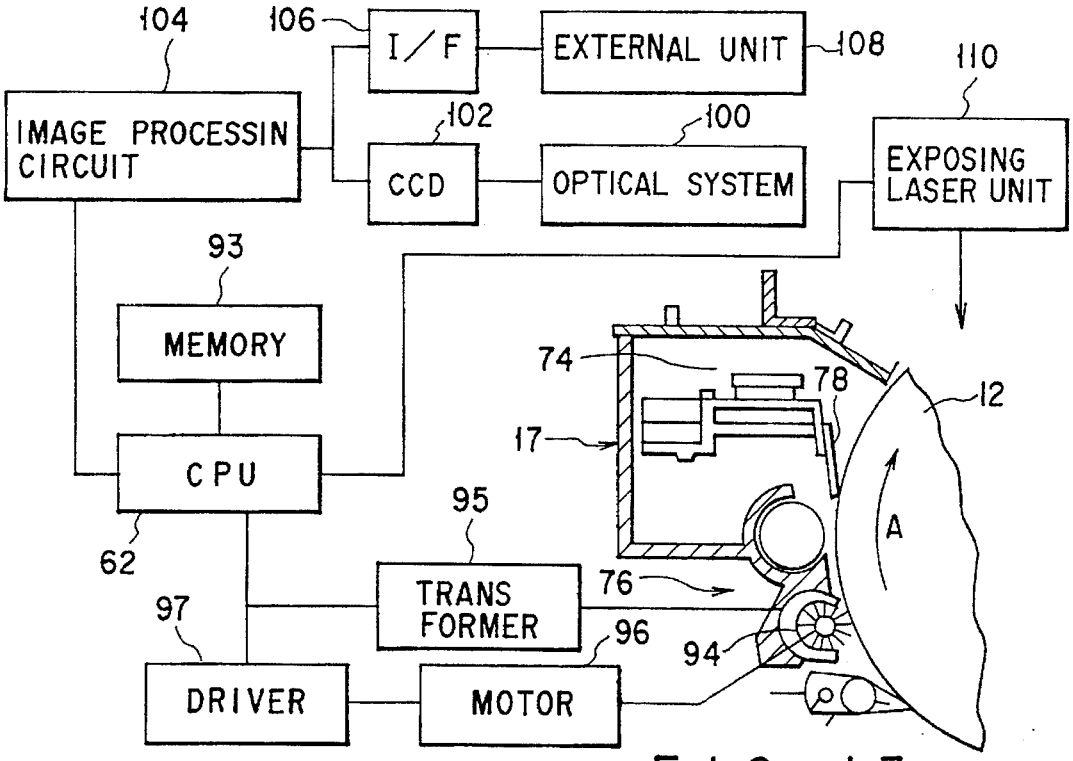
FIG. 13

IMAGE FORMING APPARATUS WITH CLEANING CAPACITY CHANGEABLE IN ACCORDANCE WITH IMAGE DENSITY

BACKGROUND OF THE INVENTION

1. Field of the Invention

The present invention relates to an image forming apparatus such as electrophotographic copying machines and printers.

2. Description of the Related Art

An image forming apparatus such as the electrophotographic copying machine has a photoconductive drum which serves as an image carrier, wherein the surface of the photoconductive drum is exposed to form an electrostatic latent image and this electrostatic latent image is then developed by means of developer to form a visible image.

Photoconductive drums of the inorganic type which use arsenic selenium, amorphous silicon (which will be hereinafter referred to as A—Si), and the like, for example, as their photoconductive material are well-known. These drums must be used while being heated to a temperature higher than the ordinary temperature, when their characteristics are taken into consideration. A drum heater or a heating lamp is thus arranged in the drum so as to heat it to a temperature, ranging from 30° C. to 50° C., higher than the ordinary temperature. By heating the drum in this manner, image deterioration due to temperature lowering of the drum can be prevented. In short, image fault such as fog can be prevented in the case of the arsenic selenium drum and image fault such as image flow can be prevented in the case of the A—Si drum.

When a photoconductive drum is used while keeping them heated as described above, however, toner adheres to the drum surface, thereby causing filming and black points. A mechanism causing black points will be described.

The inorganic photoconductive drum such as a arsenic selenium drum, A—Si drum, and the like has appearance faults such as micro-projections and film stripping on its surface and these appearance faults cannot be avoided yet in the course of producing them. When the drum is used while keeping its surface temperature higher than the ordinary temperature or when its temperature is raised depending on a copying mode selected, melting toner adheres to the micro-projections or film-stripped portions on the drum surface. The melted and adhering toner is extended and fixed on the drum surface by the cleaning blade, thereby causing black points.

When an image density of an original to be copied is high, the toner density of a developer image formed on the photoconductive drum becomes high accordingly. The amount of residual toner on the drum surface after the image is transferred to a sheet of paper increases, too. This makes it more likely to cause the above-mentioned image faults such as filming and black points.

In order to prevent these image faults such as filming and black points, it is needed that an auxiliary cleaning mechanism is provided in addition to the cleaning blade to raise cleaning capacity. Mechanisms for applying AC to the photoconductive drum, including cleaning members such as a fur brush and cleaning rollers, and discharging the photoconductive drum by a lamp are well-known as the auxiliary cleaning mechanism.

In the conventional copying machine, however, the cleaning capacity of the auxiliary cleaning mechanism is previously set to meet such a condition that toner is likely to adhere to the surface of the photoconductive drum. Specifically, the operating condition of the auxiliary cleaning mechanism is set to attain a enough cleaning capacity even when image density of the original to be copied is so high as to cause image faults such as filming and black points. Further, the auxiliary cleaning mechanism is always operated under the same condition.

In the auxiliary cleaning mechanism for applying AC, for example, cleaning capacity can be raised by increasing AC voltage applied to the photoconductive drum. Even when an original having a high image density is to be copied, therefore, image faults can be prevented by setting AC voltage high enough. When this high AC voltage is applied to the drum at all times, however, the amount of harmful ozone caused becomes larger. This is not preferable.

In the auxiliary cleaning mechanism provided with a cleaning member such as a fur brush or a cleaning rollers, cleaning efficiency can be raised by increasing the rotation number of the cleaning member. When the rotation number is set high enough, therefore, image faults can be prevented. When the cleaning member is usually operated at this high rotation number, however, its life become shorter and toner adhering to the cleaning member is scattered in the copying machine to a greater extent. This is not preferable, too.

In the auxiliary cleaning mechanism having the discharge lamp, cleaning efficiency can be raised by increasing voltage applied to the lamp to make it brighter. In this case, however, lamp life becomes shorter.

SUMMARY OF THE INVENTION

The present invention is therefore intended to eliminate the above-mentioned drawbacks and its object is to provide an image forming apparatus which are capable of preventing image faults caused by the density of images to be formed, without increasing the amount of ozone caused and shortening the life of the cleaning mechanism.

In order to achieve the above object, an image forming apparatus according to the present invention comprises means for forming a developer image on an image carrier by supplying developer to the image carrier; means for detecting image density of the developer image formed on the image carrier and supplying a detection signal corresponding to the detected image density; means for cleaning developer remaining on the image carrier; and means for varying cleaning capacity of the cleaning means in accordance with the detection signal.

According to the apparatus of the present invention, developer remaining on the image carrier is cleaned by the cleaning means. The cleaning capacity of the cleaning means is adjusted responsive to the image density detected by the detecting means. Specifically, it is raised by the varying means as the image density becomes higher and it is lowered as the image density becomes lower.

Further, another image forming apparatus according to the present invention comprises means for forming a developer image on a rotatable image carrier by supplying developer to the image carrier; means for detecting image density of the developer image formed on the image carrier and supplying a detection signal corresponding to the detected image density; main cleaning means arranged to contact with the image carrier, for cleaning developer remaining on the image carrier; auxiliary cleaning means arranged on an upstream side of the main cleaning means with respect to the rotating direction of the image carrier, for reducing attraction of the developer to the image carrier; and means for varying cleaning capacity of the auxiliary cleaning means in accordance with the detection signal.

According to the apparatus of the present invention, developer remaining on the image carrier is cleaned by the main cleaning means and further cleaned by the auxiliary cleaning means arranged on the upstream side of the main cleaning means. The cleaning capacity of the auxiliary cleaning means is varied responsive to the detected image density. In short, it is raised by the varying means as the detected image density becomes higher and it is lowered as the image density becomes lower.

When AC applying means, for example, is used as the auxiliary cleaning means, AC applying voltage is increased as the image density becomes higher. When the image density becomes so high as to cause image faults such as filming and black points, AC applying voltage is set to be a value to attain a cleaning capacity enough to prevent image faults.

When a cleaning member in rolling contact with the image carrier is used as the auxiliary cleaning means, the rotating speed of the cleaning member is increased as the image density becomes higher. When the image density becomes so high as to cause image faults such as black points, the rotating speed is set to be a value to attain the cleaning capacity enough to prevent image faults.

When means for discharging the image carrier by exposure is used as the auxiliary cleaning means, the light quantity of the discharging means is increased as the image density becomes higher. When the image density becomes so high as to cause image faults such as filming and black points, the light quantity of the discharging means is set to be a value to attain the cleaning capacity enough to prevent image faults.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 through 6 show an analog copying machine of the electrophotographic type according to an embodiment of the present invention, in which:

FIG. 1 is a sectional view showing the whole of the copying machine,

FIG. 2 is a perspective view schematically showing an original mount table and a part of an exposing optical system of the copying machine, FIG. 3 is a view schematically showing a photoconductive drum of the copying machine and components around it, FIG. 4 is a graph showing the relationship between image density of an original and output voltage of an automatic exposure sensor, FIGS. 5A and 5B (hereinafter collectively referred to as FIG. 5) are graphs showing the relationship between the output voltage of the automatic exposure sensor, black points caused, and AC values, and FIGS. 6A and 6B (hereinafter collectively referred to as FIG. 6) are graphs showing the relationship between the output voltage of the automatic exposure sensor, black points caused, and the number of paper sheets passed;

FIGS. 7 through 9 show a first modification of the auxiliary cleaning mechanism, in which:

FIG. 7 is a view schematically showing a cleaning device having a fur brush which serves as the auxiliary cleaning mechanism, FIGS. 8A and 8B (hereinafter collectively referred to as FIG. 8) are graphs showing the relationship between output voltage of the automatic exposure sensor, black points caused, and peripheral speed rates of the fur brush and the photoconductive drum, and FIGS. 9A and 9B (hereinafter collectively referred to as FIG. 9) are graphs showing the relationship between the output voltage of the automatic exposure sensor, black points caused, and the number of paper sheets passed;

FIGS. 10 through 12 show a second modification of the auxiliary cleaning mechanism, in which:

FIG. 10 is a view schematically showing a cleaning device having a discharging light source which serves as the auxiliary cleaning mechanism, FIGS. 11A and 11B (hereinafter collectively referred to as FIG. 11) are graphs showing the relationship between output voltage of the automatic exposure sensor, black points caused, and voltage applied to an inverter circuit, and FIGS. 12A and 12B (hereinafter collectively referred to as FIG. 12) are graphs showing the relationship between the output voltage of the automatic exposure sensor, black points caused, and the number of paper sheets passed;

FIG. 13 is a schematic view of a digital copying machine according to another embodiment of the present invention.

DETAILED DESCRIPTION OF THE PREFERRED EMBODIMENTS

An embodiment in which the present invention is applied to an analog copying machine of the electrophotographic type will be described with reference to the accompanying drawings.

Figure 1:
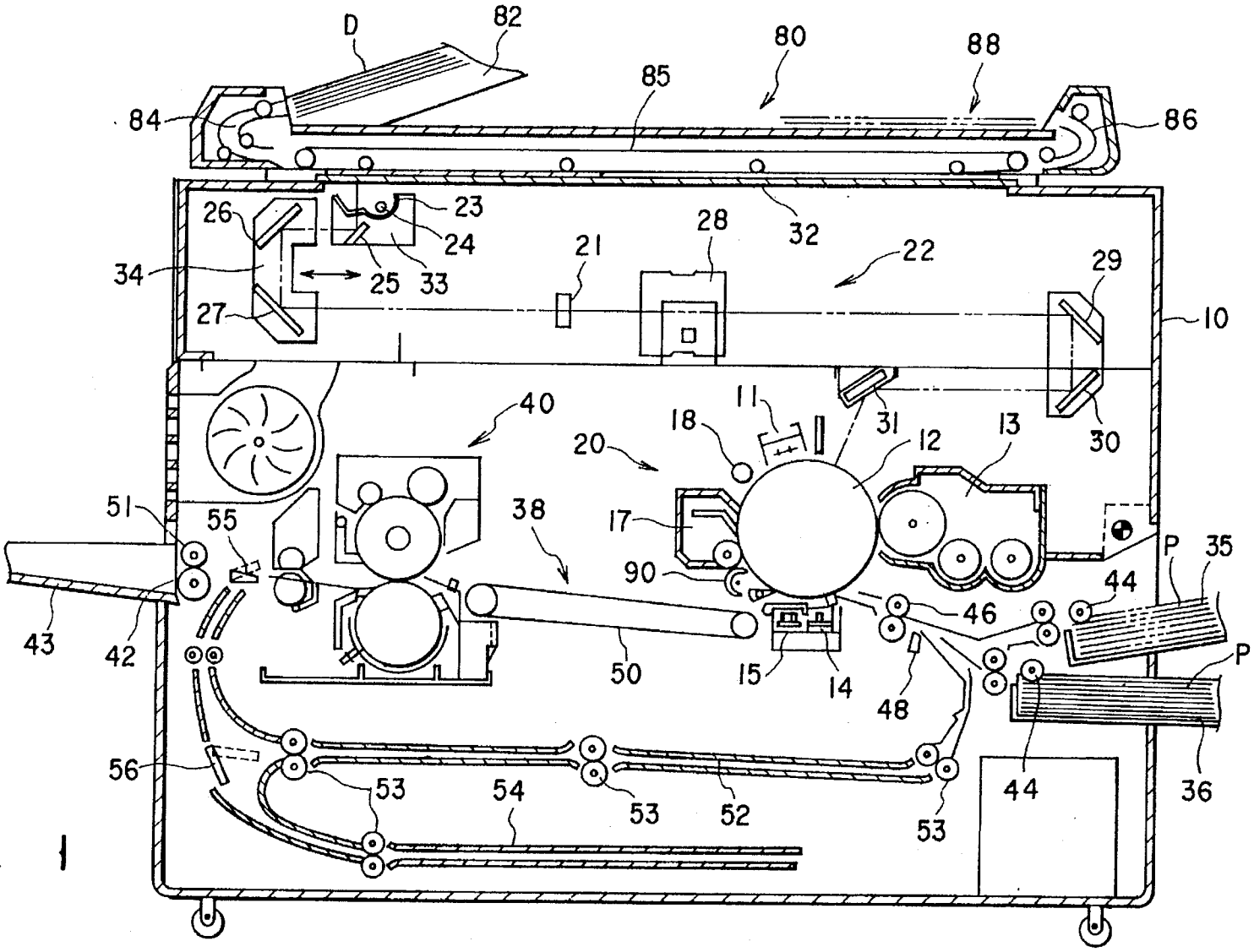

As shown in FIG. 1, the copying machine has a housing 10 and a photoconductive drum which serves as an image carrier is rotatably arranged in the housing 10 substantially at the center thereof. An electrifying charger 11, a developing device 13, a transfer charger 14, a peeling charger 15, a peeling claw 16, a cleaning device 17, and a discharge lamp 18 are arranged around the photoconductive drum 12 in this order, thereby forming an image forming section 20.

An original mount table 32 formed of a transparent glass is arranged in the top of the housing 10. An optical system 22 for exposure is arranged under the original mount table 32 and above the image forming section 20. The exposing optical system 22 includes an exposure lamp 24 backed by a reflector 23, and a first reflecting mirror 25 which is mounted together with the exposure lamp 24 on a first carriage 33. It also includes second and third reflecting mirrors 26 and 27 mounted on a second carriage 34 and movable integrally with each other, a lens unit 28, and fourth, fifth and sixth fixed reflecting mirrors 29, 30 and 31.

Figure 2:
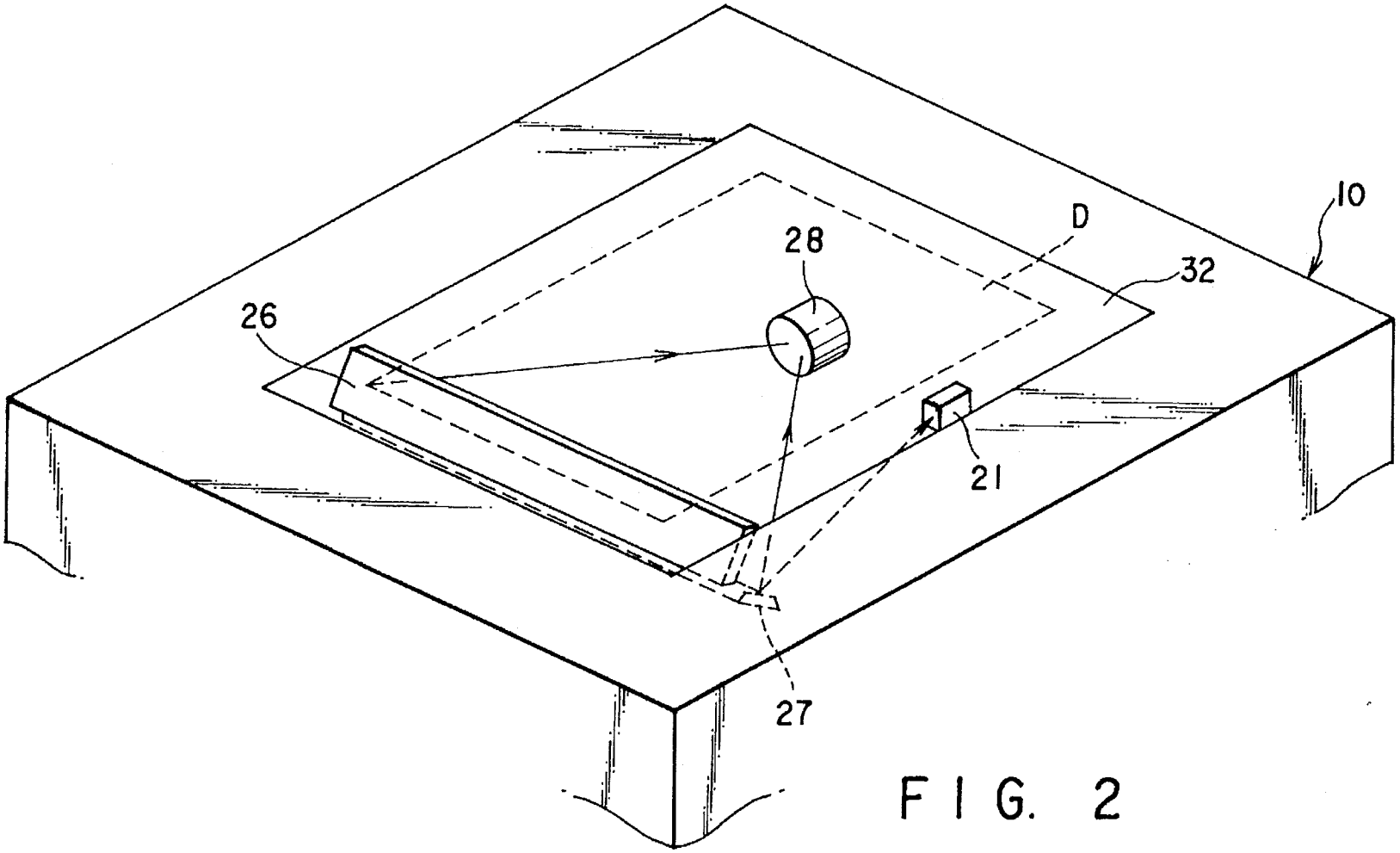

As shown in FIGS. 1 and 2, an automatic exposure sensor 21 is arranged between the third reflecting mirror 27 and the lens unit 28 to measure the quantity of light exposed. More specifically, the automatic exposure sensor 21 is arranged at such a position that is in same plane as the plane in which the lens unit 28 is arranged, namely, that is in an area through which light transmitted from the third reflecting mirror 27 to the fourth reflecting mirror 29 passes but that does not shield the light traveling to the fourth reflecting mirror 29. A part of the light reflected by the third mirror 27 enters into the automatic exposure sensor 21 and this sensor 21 supplies output voltage, which corresponds to the density of an image, as detection or density signal, to a CPU 92 which will be described later. The automatic exposure sensor 21 serves as detecting means for detecting the image density of an original D.

The above-described exposing optical system 22 scans an original D placed on the original mount table 32 by light beam emitted the exposure lamp 24 and introduces the light beam reflected by the original to the photoconductive drum 12 via the first through sixth reflecting mirrors and the lens unit 28, to thereby expose the surface of the photoconductive drum 12. An electrostatic latent image which corresponds to an image on the original is thus formed on the surface of the drum 12 which has been uniformly electrified by the electrifying charger 11. The electrostatic latent image thus formed is developed with toner, which serves as developer, by the developing device 13, thereby forming a developer image.

On the top of the housing 10 is arranged an automatic document feeder 80 (hereinafter it is called as ADF) for automatically feeding documents or originals onto the original mount table 32. The ADF 80 includes an original tray 82 on which originals D are mounted, and an original conveying belt 85. Originals mounted on the original tray 82 are introduced one by one to the original mount table 32 through a conveying passage 84 and positioned by the conveying belt 85. After exposed, each original is conveyed through a conveying passage 86 and discharged onto an original discharge section 88 on the top of the ADF 80 by the conveying belt 85.

First and second cassettes 35 and 36 in which a plurality of paper sheets P serving as transfer material are stored are detachably fitted to a side of the housing 10 at the lower portion thereof. In the housing is defined a conveying passage 38 along which paper sheets P picked up from the first and second cassettes 35 and 36 are conveyed, passing through an image-transferring section between the photoconductive drum 12 and the transfer charger 14. A fixing unit 40 is arranged at the end of the conveying passage 38. A discharging opening 42 is formed in that side of the housing 10 which is opposed to the fixing unit 40 and a paper sheet discharge tray 43 is attached to the discharging opening 42.

A pickup roller 44 is arranged adjacent to each of the first and second cassettes 35 and 36 to pick up the paper sheets P from each cassette. Resist rollers 46 are also arranged upstream the photoconductive drum 12 along the conveying passage 38 to align the paper sheets P conveyed. A sensor 48 is further arranged adjacent to the resist rollers 46 to detect the paper sheets P conveyed.

The paper sheet P which has been picked up from the first or second cassette 35 or 36 is aligned by the resist rollers 46 and then conveyed to the image-transferring section, where the developer image on the photoconductive drum 12 is transferred onto the paper sheet P by the transferring charger 14.

The paper sheet P on which the developer image has been transferred is peeled from the photoconductive drum 12 by AC corona discharge applied from the peeling charger 15 and by the peeling claw 17, and then it is fed to the fixing unit 40 by a conveying belt 50 which defines a part of the conveying passage 38. After the developer image is melted and fixed on the paper sheet P by the fixing unit 40, the paper sheet is discharged on the discharging tray 43 by discharging rollers 51.

A re-conveying passage 52 for again introducing the paper sheets P, which have passed the fixing unit 40, to the image-transferring section through the resist rollers 46, and a turn-over passage 54 branching from the re-conveying passage 52 and serving to turn over the paper sheets P are arranged below the conveying passage 38. Plural conveying rollers 53 are arranged along these re-conveying and turn-over passages 52 and 54 to convey the paper sheets P. A first distributing gate 55 is arranged between the fixing unit 40 and the discharging rollers 51 to introduce the paper sheets P to the re-conveying passage 52 and a second distributing gate 56 is arranged on the way of the re-conveying passage 52 to introduce them to the turn-over passage 54.

When copying is to be repeated on a face of a paper sheet P, the paper sheet P which has passed through the fixing unit 40 is introduced to the re-conveying passage 52 by the first distributing gate 55 and then to the resist rollers 46. After aligned by the resist rollers 46, the paper sheet P is again sent to the image-transferring section where another image is again transferred on the paper sheet. Thereafter, it is discharged on the discharging tray 43 through the conveying passage 38, the fixing unit 40 and the discharging rollers 51.

When copying is to be conducted on both faces of a paper sheet P, the paper sheet P which has passed through the fixing unit 40 is introduced to the turn-over passage 54 by the first and second distributing gates 55 and 56 and then turned over and sent to the re-conveying passage 52 through the second distributing gate 56. It is further sent to the resist rollers through the re-conveying passage 52 and aligned by them. Thereafter, another developer image is transferred on the back of it at the image-transferring section. The paper sheet is then discharged on the discharge tray 43 through the conveying passage 38, the fixing unit 40 and the discharging rollers 51.

The photoconductive drum 12 and the image forming section 20 will be described in detail.

Figure 3:
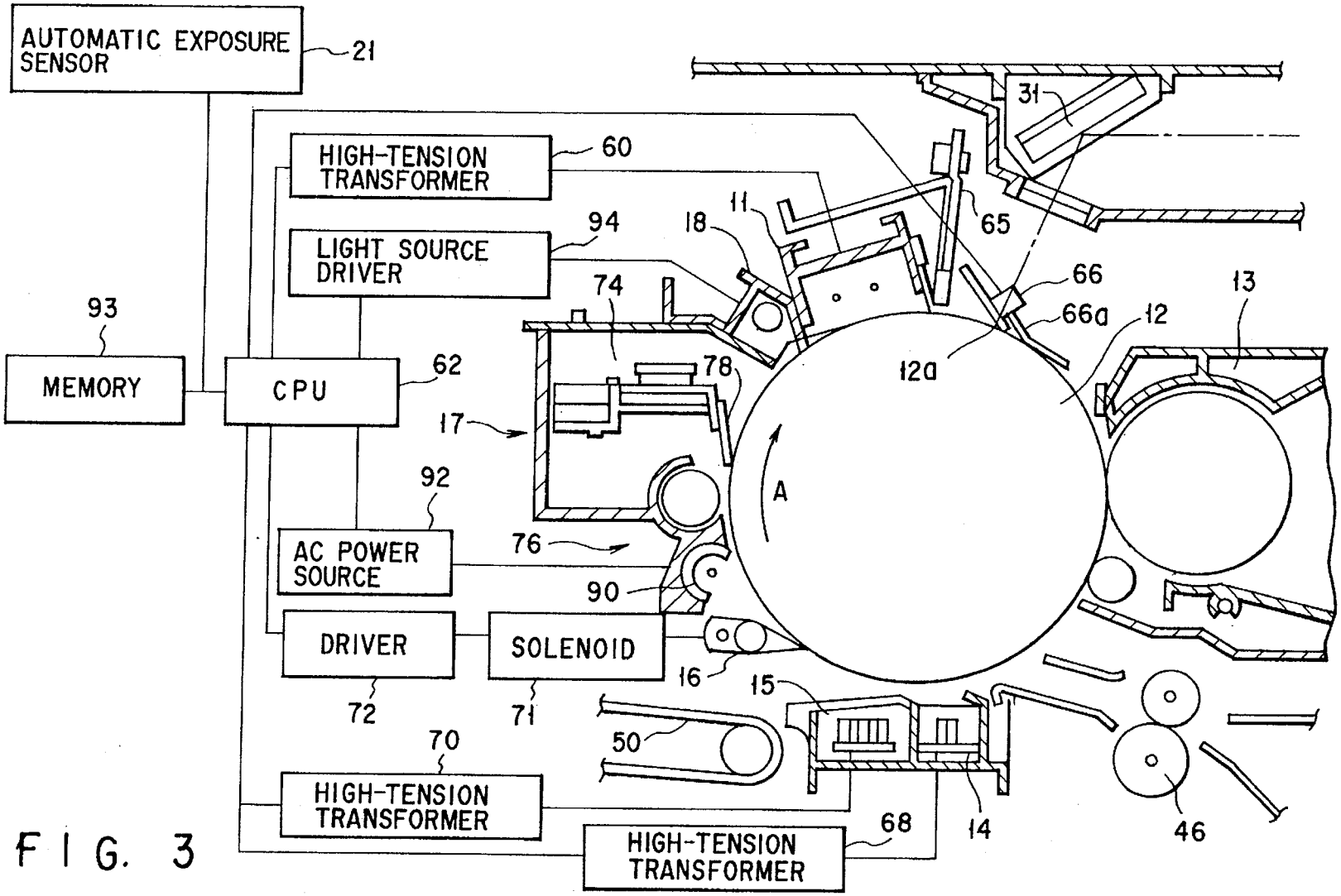

As shown in FIG. 3, the photoconductive drum 12 comprises a cylindrical drum made of aluminum, for example, and a photoconductive layer of arsenic selenium, for example, formed on the surface of the drum. A heater (not shown) for heating the drum is arranged along the inner face of the drum.

The electrifying charger 11 for electrifying the surface of the photoconductive drum 12 to a certain potential is connected to a CPU 62 via a high-tension transformer 60. A partly-erasing LED 65 is arranged between the electrifying charger 11 and the developing device 13. A thermistor 66 for detecting the surface temperature of the photoconductive drum 12 is arranged between the LED 65 and the developing device 13. An actuator **66*a* of the thermistor 66 is in contact with the surface of the photoconductive drum 12 at one end thereof. The thermistor 66 sends detection signal to the CPU 62**.

The transfer charger 14 for transferring the toner image on the photoconductive drum 12 to the paper sheet P and the peeling charger 15 for peeling the paper sheet from the photoconductive drum 12 are arranged upstream the developing device 13 with respect to the rotating direction A of the drum 12. The transfer charger 14 and the peeling charger 15 are formed as a unit and connected to the CPU 62 through high-tension transformers 68 and 70, respectively. The peeling claw 16 arranged downstream the peeling charger 15 is driven by a solenoid 71, which is connected to the CPU 62 through a driver 72. The electrifying charger 11, the developing device 13, the transfer charger 14 and others constitute image forming means of the present invention.

The automatic exposure sensor 21 applies output voltage which denotes the image density of an original, as density signal, to the CPU 62. As shown in FIG. 4, the value of output applied from the automatic exposure sensor 21 becomes lower as the image density of an original or document D is higher and it increases linearly as the image density becomes lower. As the image density becomes higher, the amount of developer supplied to the photoconductive drum 12 by the developing device 13 is increased, and the amount of toner remaining on the drum 12 after the image-transferring process is also increased.

A memory 93 in which desired control data are stored and a light source driver 94 for driving the discharge lamp 18 are connected to the CPU 62.

On the other hand, the cleaning device 17 for cleaning toner not transferred to the paper sheet P but remaining on the surface of the photoconductive drum 12 includes a main cleaning mechanism 74 serving as main cleaning means, and an auxiliary cleaning mechanism 76 arranged upstream the main cleaning mechanism with respect to the rotating direction of the photoconductive drum 12, and serving as auxiliary cleaning means. The main cleaning mechanism 74 has a cleaning blade 78, which is in contact with the surface of the photoconductive drum 12 to scrape the residual toner from the drum surface.

The auxiliary cleaning mechanism 76 includes a charger 90 serving as AC applying means for applying AC voltage to the surface of the photoconductive drum 12, and an AC power source 92 for supplying AC voltage to the charger 90, and the AC power source 92 is connected to the CPU 62. When AC voltage is applied from the charger 90 to the surface of the photoconductive drum 12, electric charge on the drum surface and electric charge of the toner remaining on the drum surface are canceled, thereby reducing electrostatic attraction between the residual toner and the drum 12. This makes it easier for the cleaning blade 78 to remove the residual toner from the drum surface. The auxiliary cleaning mechanism 76, therefore, assists the main cleaning mechanism 74 and increases the cleaning capacity of the cleaning device 17.

The CPU 62 serves as varying means and control means in the present invention and varies the cleaning capacity of the auxiliary cleaning mechanism 76 in accordance with the image density of the original D detected by the automatic exposure sensor 21. Specifically, the CPU 62 controls the operation of the AC power source 92, responsive to the image density of the original D, to thereby increase or decrease voltage supplied to the charger 90. The value of current flowing to the surface of the photoconductive drum 12 can be thus changed to adjust the cleaning capacity of the auxiliary cleaning mechanism 76.

Table 1 shows results obtained by checking the relation between values of current flowing to the photoconductive drum 12 through the auxiliary cleaning mechanism 76 and the cleaning capacity of the whole cleaning device 17.

TABLE 1

| AC current flowing to the drum (μ A/50 mm) | Cleaning capacity | Ozone density around the drum (ppm) |
|---|---|---|
| 10 | xx (NG) | 0.15 |
| 30 | Δ | 0.31 |
| 50 | Δ | 0.63 |
| 70 | o | 0.85 |
| 90 | o | 1.21(NG) |

In checking, Load applied to the cleaning blade 78 is made half the usual value so as to provide a condition under which fault cleaning is likely to be caused. An image was formed on the photoconductive drum 12 and cleaned by the cleaning blade under this condition. The cleaning capacity was valued by checking whether or not toner was left on the photoconductive drum 12. Symbol x in table 1 denotes that the cleaning was poor, symbol Δ that it was not enough, and symbol o was excellent. It can be understood from table 1 that the cleaning capacity of the cleaning device is made higher as the value of AC current flowing to the photoconductive drum is increased.

When the value of AC current is increased, however, ozone density round the photoconductive drum tends to increase. Therefore, it is not preferable that the value of AC current flowing to the drum is made higher than needed or higher than 90 μA when results in table 1 are taken into consideration.

FIG. 5 shows results obtained by checking the relationship between image density of an original, fault images or black points caused, and values of AC current flowing to the drum. Arsenic selenium was used as the photoconductive layer on the photoconductive drum, and toner for the leodry 6550 (trade name) (65CPM) made by Toshiba Corporation was used as developer. Originals having different image densities were used and continuously copied on 30,000 sheets of paper under a mode of continuously copying images on each of A4-sized paper sheets along the longer axis thereof. Thereafter, toner image on the drum surface was transferred to A3-sided paper sheet and the number of black points was checked about white areas of the A3-size paper sheet.

As shown by broken lines in FIG. 5, the number of black points caused is increased as the image density of the original becomes higher. In short, fault images become more as the output of the automatic exposure sensor becomes smaller than 3 V. As shown by solid lines in FIG. 5, however, it has been found that the number of black points caused is negligible when the cleaning capacity is made higher by increasing the value of AC current flowing to the drum surface through the auxiliary cleaning mechanism 76 in the range of 40 μA to 80 μA in accordance with increase in the image density.

Values of AC current obtained from the results in FIG. 5 and needed to keep the number of black points negligible as the image density changes are stored, as control data, in the memory 93. The CPU 62 controls the auxiliary cleaning mechanism on the basis of the control data in such a way that the value of AC current changes in accordance with original image density changes detected by the automatic exposure sensor 21. FIG. 6 shows results obtained by continuously copying images on paper sheets under the above mode while controlling the auxiliary cleaning mechanism 76 as described above. Three originals each having a different image density were prepared in this case and each original was copied on 100K paper sheets to check fault images. It can also be understood in this case that the number of black points caused is kept smaller than the negligible level. The causing of fault images can be thus prevented.

According to the above-described arrangement, the cleaning capacity of the auxiliary cleaning mechanism, that is, the value of AC current is adjusted responsive to the image density of each original. This can prevent the value of AC current from being made higher than needed. Any increase of ozone density can be prevented accordingly. FIG. 7 shows a modification of the auxiliary cleaning mechanism 76, which is provided with a fur brush 94 serving as a cleaning member, instead of the AC current charger. The fur brush 94 is arranged in rolling contact with the surface of the photoconductive drum 12 and a certain bias voltage is applied to the fur brush through a transformer 95. It is rotated by a reversible motor 96, which is connected to the CPU 62 through a driver 97 and whose rotating speed and direction are controlled by the CPU. The motor 96 and the driver 97 form drive means in the present invention.

According to the above-described auxiliary cleaning mechanism 76, toner not transferred but remaining on the surface of the photoconductive drum can be scraped from the drum surface by the fur brush 94 which is rotated to rub the drum surface. At the same time, electric charges on the residual toner and the drum surface are canceled by bias voltage applied from the transformer 95 to the fur brush 94, thereby reducing electrostatic attraction between the residual toner and the photoconductive drum. As the result, the residual toner can be more easily removed by the cleaning blade 78 and the cleaning capacity of the whole cleaning device 17 can be increased accordingly.

The CPU 62 varies the cleaning capacity of the auxiliary cleaning mechanism 76 in response to the image density of an original detected by the automatic exposure sensor 21. More detail, the CPU 62 controls the operation of the driver 97, responsive to output voltage applied from the automatic exposure sensor 21, to change drive current supplied to the motor 96. Rotating number and direction of the fur brush 94 rotated by the motor 96 are thus changed to adjust the cleaning capacity of the auxiliary cleaning mechanism 76.

Other components which are not included in the above-described auxiliary cleaning mechanism are same as those in the first embodiment, and detailed description on them will be omitted accordingly.

Table 2 shows results obtained by checking how the peripheral speed rate of the fur brush 94 and the photoconductive drum 12 is related to the cleaning capacity of the cleaning device 17.

TABLE 2

| Peripheral speed rate of fur brush and photoconductive drum | Cleaning capacity |
|---|---|
| 1.0 | xx (NG) |
| 1.2 | x (NG) |
| 1.4 | Δ |
| 1.6 | o |
| 1.8 | o |

In checking, load added to the cleaning blade 78 is made half the usual value so as to provide a condition under which fault cleaning is likely to be caused. An image was formed on the photoconductive drum and cleaned by the cleaning blade under this condition. The cleaning capacity was checked by seeing whether or not any black point was left on the drum after the cleaning process. In table 2, symbol x represents that the cleaning was not good or poor, symbol Δ that the cleaning was not enough, and symbol o that the cleaning was excellent. Carbon was pasted to a rayon fur brush each fur filament having a diameter of ϕ 15 to make the brush conductive, and this fur brush thus prepared was used. Bias voltage applied to the fur brush was 200 V, and the fur brush was rotated forward, i.e., in the direction opposite to the rotating direction of the photoconductive drum.

It can be understood from the results that the cleaning capacity attained by the cleaning blade is enhanced as the peripheral speed rate of the fur brush 94 relative to the photoconductive drum 12 is made larger or as the rotating speed of the fur brush is increased. When the rotating speed of the fur brush 94 is increased, however, the life of the brush is shortened. In addition, the amount of toner scattered from the fur brush increases. It is therefore not desirable that the rotating speed of the fur brush is increased more than needed.

FIG. 8 shows results obtained by checking how the image density detected by the automatic exposure sensor 21 is related to black points caused and to the peripheral speed rate of the fur brush and the photoconductive drum. Arsenic selenium was used as the photoconductive matter on the drum and toner for the leodry 6550 (for 65CPM machine) (trade name) made by Toshiba Corporation was used as developer. The fur brush use was same as the above-mentioned one and it was rotated forward (as shown by a solid line in FIG. 8) or backward (as shown by a dot and dash line), i.e., in the direction same as the rotating direction of the drum 12. Bias voltage applied to the fur brush was 200 V. Originals each having a different image density were used and continuously copied on 30,000 paper sheets under the A4-size continuous copying mode. Thereafter, toner image on the drum was transferred to a A3-sized paper sheet and the number of black points caused in white areas of the A3-sized paper sheets was checked.

As shown by broken lines in FIG. 8, the number of black points caused is increased and fault images are caused as output voltage of the automatic exposure sensor 21 becomes smaller than 3 V in a case where the peripheral speed rate is kept certain. When the cleaning capacity of the auxiliary cleaning mechanism 76 is enhanced by increasing the rotating speed of the fur brush 94, which is rotated forward, or by making the peripheral speed rate higher as the image density of each original becomes higher, the number of black points caused can be kept at the negligible level.

As shown by one dot and dashed line in FIG. 8, by changing the rotating direction of the fur brush 94 to the reverse direction, the cleaning capacity of the auxiliary cleaning mechanism 76 can be increased. Further, by increasing the rotating speed of the fur brush 94 or by making the peripheral speed rate higher as the image density of each original becomes higher, the cleaning capacity of the auxiliary cleaning mechanism 76 can be further improved and the number of black points caused can be kept at the negligible level.

Peripheral speed rates of the fur brush 94 and the rotating speed thereof obtained as the results and needed to keep the number of caused black points at the negligible level are stored, as control data, in the memory 93. The CPU 62 controls rotating speed and rotating direction of the fur brush 94 on the basis of the control data in such a way that the peripheral speed rate changes every original, responsive to the image density of the original detected by the automatic exposure sensor 21.

FIG. 9 shows results obtained by copying images on paper sheets under the A4-size continuous copying mode while controlling the auxiliary cleaning mechanism 76 as described above. Three originals each having a different image density were prepared in this case and each of them was copied on 100K paper sheets to check the number of fault images. It can be understood from the results that the number of black points caused is kept lower than the negligible level even when various originals each having a different image density are copied. The causing of fault images can be thus effectively prevented.

According to the above-described arrangement, the cleaning capacity of the auxiliary cleaning mechanism 76 or the rotating speed of the fur brush 94 is adjusted in accordance with the image density of each original. Therefore, the rotating speed of the fur brush is not increased more than needed. This can prevent the life of the fur brush from being shortened. In addition, the scattering of toner from the fur brush can be prevented.

In the above-described embodiment, a cleaning roller may be used instead of the fur brush 94 and same effect can also be attained in this case.

FIG. 10 shows another modification of the auxiliary cleaning mechanism 76 which is provided with a discharge light source 98 instead of the AC charger. A green cold cathode tube having a center wave length of 540 nm is used as the discharge light source 98 and it is opposed to the outer circumference of the photoconductive drum 12. The discharge light source 98 is connected to the CPU 62 via an inverter circuit 99 which causes it to emit light. Light quantity of the light source 98 can be adjusted by controlling the voltage applied to the inverter circuit 99 by the CPU 62. The inverter circuit 99 and the CPU 62 are components to constitute control means in the present invention.

According to the above-described auxiliary cleaning mechanism 76, electric charge of toner not transferred but remaining on the surface of the photoconductive drum 12 can be removed by radiating light from the discharge light source 98 to the drum surface. Electrostatic attraction between the residual toner and the photoconductive drum can be thus reduced, thereby making it easier for the residual toner to be removed by the cleaning blade 78. As the result, the cleaning capacity of the whole cleaning device 17 can be enhanced to a greater extent.

The CPU 62 adjusts the cleaning capacity of the auxiliary cleaning mechanism 76 in accordance with the image density of each original detected by the automatic exposure sensor 21. In short, the CPU 62 controls the operation of the inverter circuit 99, responsive to the image density, to change voltage applied to the discharge light source 98. The quantity of light emitted from the discharge light source 98 is thus changed to vary the cleaning capacity of the auxiliary cleaning mechanism 76.

Components which are not included in the auxiliary cleaning mechanism are same as those in the above-described variations and detailed description on them will be omitted accordingly.

Table 3 shows results obtained by checking how voltage applied to the inverter circuit 99, the light quantity of the discharge light source 98 and the cleaning capacity of the cleaning device 17 are related to one another.

TABLE 3

| Voltage applied to inverter (V) | Discharge light quantity before cleaning (Lux) | Cleaning capacity |
|---|---|---|
| 16 | 450 | x (NG) |
| 20 | 850 | Δ |
| 24 | 1640 | Δ |
| 28 | 1640 | o |
| 32 | 2080 | o |

In checking, load added to the cleaning blade 78 is made half the usual value so as to provide a condition under which fault cleaning is likely to be caused. An image was formed on the photoconductive drum and cleaned by the cleaning blade under this condition. The cleaning capacity was then valued by checking whether or not toner was still left on the drum surface. In table 3, symbol x denotes that the cleaning was not good or poor, symbol Δ that the cleaning was not enough, and symbol o that the cleaning was excellent.

It can be understood from the results that the cleaning capacity of the cleaning blade 76 is enhanced by increasing the light quantity of the discharge light source 98 relative to the photoconductive drum 12. When the light quantity of the discharge light source 98 is kept large, however, its lift is shortened. It is therefore not desirable that the light quantity is increased to an extent greater than needed.

FIG. 11 shows results obtained by checking how the output voltage of the automatic exposure sensor 21, the number of black points caused, and voltage applied to the inverter circuit 99 are related to one another. Arsenic selenium was used as photoconductive matter on the photoconductive drum and toner for the leodry 6550 (65CPM machine) (trade name) made by Toshiba Corporation was used as developer. The green cold cathode tube having the center wave length of 540 nm was used as the discharge light source. Originals each having a different image density were used and continuously copied on 30,000 paper sheets under the A4-size continuous copying mode. Thereafter, toner image on the drum was transferred to a A3-sized paper sheet, and the number of black points caused in white areas of the paper sheet was checked.

In a case where voltage applied to the inverter circuit or the quantity of light emitted from the discharge light source 98 is kept constant, as the output voltage of the automatic exposure sensor 21 becomes lower than 3 V, the amount of remaining toner is increased and the number of black points caused is thus increased to thereby cause fault images, as shown by broken lines in FIG. 11. However, it has been found that the number of black points caused can be kept at a negligible level, as shown by solid lines, when the cleaning efficiency of the auxiliary cleaning mechanism is enhanced by increasing voltage applied to the inverter circuit 99 or the light quantity of the discharge light source 98 in accordance with decrease in the output voltage of the automatic exposure sensor 21.

Voltages applied to the inverter circuit 99, obtained from the results in FIG. 11 and needed to keep the number of black points at the negligible level are stored, as control data, in the memory 93. The CPU 62 controls the voltage applied to the inverter circuit 99 on the basis of the control data in such a way that the quantity of light emitted from the discharge light source 98 varies in response to the output voltage from the automatic exposure sensor 21 or the image density of each original. FIG. 12 shows results obtained by copying images on paper sheets under the A4-size continuous copying mode while controlling the auxiliary cleaning mechanism 76 as described above. Three originals each having a different image density were prepared and each of them was copied on 100 k paper sheets in this case to check whether or not fault images are caused. It can be understood from the results that the number of black points caused is kept lower than the negligible level to effectively prevent the causing of fault images even when various originals each having a different image density are copied.

According to the above-described arrangement, the cleaning capacity of the auxiliary cleaning mechanism 76, that is, the quantity of light emitted from the discharge light source 98 is adjusted responsive to the image density of each original. Therefore, the light quantity of the discharge light source 98 is not increased to an extent greater than needed to thereby prevent its life from being shortened.

In the above-described third variation, the discharge light source 98 is not limited to the cold cathode tube. Art LED may be used instead. Further, the wave length of light emitted from the discharge light source can be variously selected depending upon the spectral sensitivity of the photoconductive drum.

The present invention is not limited to the above-described embodiments but various modifications can be made within the scope of the present invention. Although the AC voltage, peripheral speed rate, and voltage applied to the inverter circuit have been changed linearly in accordance with the image density of each original, in the above-described embodiments, they may be changed like a step. In this case, the same effect can be attained.

In the present invention, the auxiliary cleaning mechanism may be constructed by combining cleaning members such as the fur brush and the cleaning roller with the discharge light source or with the AC charger. In each combination, one of the components of the auxiliary cleaning mechanism may be used at a certain cleaning capacity while using the other to vary the cleaning capacity responsive to the image density of an original. Or it may be arranged that both components are used to change the their cleaning capacity responsive to the image density.

Still further, the present invention is not limited to an analog copying machine but it may be applied to other image forming apparatus such as a digital copying machine and a laser printer.

FIG. 13 schematically shows a digital copying machine of the electrophotographic type to which the present invention is applied. The digital copying machine includes an optical system 100 for optically scanning an original placed on the original mount table, a CCD sensor 102 for receiving light beam reflected by the original and introduced by the optical system 100 to convert it to electric signal, and an image processing circuit 104 for conducting various image processes with the signal applied from the CCD sensor. The image processing circuit 104 is connected to a CPU 62. An external unit 108 such as a computer can input image data into the image processing circuit 104 through an interface 106.

The CPU 62 drives a laser exposure unit 110, responsive to the image data from the image processing circuit 104, to form an electrostatic latent image on the photoconductive drum 12.

An auxiliary cleaning mechanism 76 includes a fur brush 94 which serves as a cleaning member. The fur brush 94 is in rolling contact with the surface of the photoconductive drum 12 and a certain bias voltage is applied to the fur brush through a transformer 95. The fur brush 94 is driven by a reversible motor 96, which is connected to the CPU 62 through a driver 97 and whose rotating speed and direction are controlled by the CPU.

Organic photoconductive material (OPC) is used as the photoconductive layer on the photoconductive drum 12. Other components are same as those in the above-described first embodiment and detailed description thereof will be omitted accordingly.

According to the digital copying machine, the CPU 62 detects the image density of an image to be formed on the photoconductive drum 12, in accordance with the image data sent from the image processing circuit 104, such as an area rate of each image occupied in an image screen, to thereby adjust the cleaning capacity of the auxiliary cleaning mechanism 76 in accordance with the detected image density. More specifically, the CPU 62 controls the operation of the driver 97 based on the image density so as to change drive voltage supplied to the motor 96. Rotating number and direction of the fur brush 94 rotated by the motor 96 are thus changed to vary the cleaning capacity of the auxiliary cleaning mechanism 76.

Same effect as that attained by the above-described embodiments can be achieved by this digital copying machine. An AC charger or a discharge light source same as those in the first through third embodiments may be used instead of the fur brush to form the auxiliary cleaning mechanism in the digital copying machine or a laser printer.

According to the present invention described above in detail, there can be provided image forming apparatus capable of preventing fault images from being caused by changing the cleaning capacity of the cleaning device in accordance with the image density of each image, and also capable of preventing the amount of ozone caused from being increased and the life of the cleaning mechanism from being shortened by increasing the cleaning capacity of the cleaning mechanism only when the image density becomes higher than a predetermined value.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

means for detecting the image density of an image on a document;

means for forming a developer image, corresponding to the image on the document, on a movable image carrier by supplying developer to the image carrier;

means for transferring the developer image on the image carrier to a transfer material;

main cleaning means for cleaning developer remaining on the image carrier after the developer image is transferred;

auxiliary cleaning means arranged on an upstream side of the main cleaning means with respect to a moving direction of the image carrier, for reducing attraction of the developer to the image carrier; and means for varying cleaning capacity of the auxiliary cleaning means in accordance with the image density detected by the detecting means.

2. An image forming apparatus according to claim 1, wherein the auxiliary cleaning means includes means for applying AC voltage to the image carrier, and the varying means includes control means for adjusting the voltage supplied to the AC applying means in accordance with the image density detected by the detecting means.

3. An image forming apparatus according to claim 2, wherein the AC applying means includes a charger arranged to oppose the image carrier, and an AC power source for supplying AC voltage to the charger.

4. An image forming apparatus according to claim 1, wherein the auxiliary cleaning means includes a cleaning member in rolling contact with a surface of the image carrier, and drive means for rotating the cleaning member, and the varying means includes control means for controlling the drive means, responsive to the image density detected by the detecting means, to adjust the rotating speed of the cleaning member.

5. An image forming apparatus according to claim 4, wherein the cleaning member has a rotatable fur brush.

6. An image forming apparatus according to claim 5, wherein the fur brush is made conductive, and the auxiliary cleaning means includes a power source for applying bias voltage to the fur brush.

7. An image forming apparatus according to claim 1, wherein the auxiliary cleaning means includes a rotatable cleaning member in rolling contact with a surface of the image carrier, and drive means for selectively rotating the cleaning member in the direction opposite to and the same as the rotating direction of the photoconductive drum, and the varying means includes control means for controlling the drive means, responsive to the image density detected by the detecting means, to change the rotating direction and rotating speed of the cleaning member.

8. An image forming apparatus according to claim 1, wherein the auxiliary cleaning means includes a light source for exposing and discharging the image carrier, and the varying means includes control means for adjusting the light quantity of the light source in accordance with the image density detected by the detecting means.

9. An image forming apparatus comprising:

a document mount table on which a document is to be placed;

exposing means for radiating light onto the document placed on the document mount table and forming an electrostatic latent image, corresponding to an image on the document, on a movable image carrier by reflected light from the document;

means for detecting the image density of the image on the document based on the quantity of the light reflected from the document;

means for forming a developer image, corresponding to the image on the document, on a movable image carrier by supplying developer to the image carrier;

means for transferring the developer image on the image carrier to a transfer material;

main cleaning means for cleaning developer remaining on the image carrier after the developer image is transferred;

auxiliary cleaning means arranged on an upstream side of the main cleaning means with respect to a moving direction of the image carrier, for reducing attraction of the developer to the image carrier; and means for varying cleaning capacity of the auxiliary cleaning means in accordance with the image density detected by the detecting means.

10. An image forming apparatus comprising:

a document amount table on which a document is to be placed;

exposing means for optically scanning the document placed on the document mount table;

means for converting reflected light from the document into electric signals;

detecting means for receiving the electric signal from the converting means as image data and detecting image density of an image on the document in accordance with the image data;

means for forming an electrostatic latent image on a movable image carrier in accordance with the image data;

means for developing the electrostatic latent image by supplying developer to the electrostatic latent image to form a developer image on the image carrier;

means for transferring the developer image on the image carrier to a transfer material;

main cleaning means for cleaning developer remaining on the image carrier after the developer image is transferred;

auxiliary cleaning means arranged on an upstream side of the main cleaning means with respect to a moving direction of the image carrier, for reducing attraction of the developer to the image carrier; and means for varying cleaning capacity of the auxiliary cleaning means in accordance with the image density detected by the detecting means.

11. An image forming apparatus comprising:

means for forming a developer image on a rotatable image carrier by supplying developer to the image carrier;

means for detecting the image density of the developer image formed on the image carrier and supplying a detection signal corresponding to the detected image density;

main cleaning means arranged to contact with the image carrier, for cleaning developer remaining on the image carrier under a predetermined cleaning capacity;

auxiliary cleaning means arranged on an upstream side of the main cleaning means with respect to the rotating direction of the image carrier, for reducing attraction of the developer to the image carrier, the auxiliary cleaning means including a cleaning member in rolling contact with a surface of the image carrier, and drive means for rotating the cleaning member; and means for varying cleaning capacity of the auxiliary cleaning means in accordance with the detection signal, the varying means including control means for controlling the drive means, responsive to the image density detected by the detecting means, to adjust the rotating speed of the cleaning member.

12. An image forming apparatus comprising:

means for forming a developer image on a rotatable image carrier by supplying developer to the image carrier;

means for detecting the image density of the developer image formed on the image carrier and supplying a detection signal corresponding to the detected image density;

main cleaning means arranged to contact with the image carrier, for cleaning developer remaining on the image carrier under a predetermined cleaning capacity;

auxiliary cleaning means arranged on an upstream side of the main cleaning means with respect to the rotating direction of the image carrier, for reducing attraction of the developer to the image carrier, the auxiliary cleaning means including a rotatable cleaning member in rolling contact with a surface of the image carrier, and drive means for selectively rotating the cleaning member in the direction opposite to and the same as the rotating direction of the image carrier; and means for varying cleaning capacity of the auxiliary cleaning means in accordance with the detection signal, the varying means including control means for controlling the drive means, responsive to the image density detected by the detecting means, to change the rotating direction and rotating speed of the cleaning member.

13. An image forming apparatus comprising:

means for forming a developer image on a rotatable image carrier by supplying developer to the image carrier;

means for detecting the image density of the developer image formed on the image carrier and supplying a detection signal corresponding to the detected image density;

main cleaning means arranged to contact with the image carrier, for cleaning developer remaining on the image carrier under a predetermined cleaning capacity;

auxiliary cleaning means arranged on an upstream side of the main cleaning means with respect to the rotating direction of the image carrier, for reducing attraction of the developer to the image carrier, the auxiliary cleaning means including a light source for exposing and discharging the image carrier; and means for varying the cleaning capacity of the auxiliary cleaning means in accordance with the detection signal, the varying means including control means for adjusting the light quantity of the light source in accordance with the image density detected by the detecting means.

* * * * *